United States Patent [19]

Mochizuki

[11] 4,443,212

[45] Apr. 17, 1984

[54] APPARATUS FOR MANUFACTURE OF PAPER TUBE

[76] Inventor: Tomiyuki Mochizuki, 2474-5 Ichijyukubo, Ohbuchi, Fuji-shi, Shizuoka-ken, Japan

[21] Appl. No.: 316,226

[22] Filed: Oct. 29, 1981

[30] Foreign Application Priority Data

Mar. 27, 1981 [JP] Japan ..... 56-44163

[51] Int. Cl.[3] ..... B31C 3/00

[52] U.S. Cl. ..... 493/289; 493/290; 493/301

[58] Field of Search ..... 493/301, 299, 300, 290, 493/289, 288, 287

[56] References Cited

U.S. PATENT DOCUMENTS 982,430 1/1911 Jenkins ..... 493/301

3,756,128 9/1973 Armstrong et al. ..... 493/301 X 3,935,801 2/1976 Okazaki ..... 493/301

4,341,523 7/1982 Ikuta ..... 493/301

FOREIGN PATENT DOCUMENTS 944735 4/1949 France ..... 493/299

*Primary Examiner*—James F. Coan

*Attorney, Agent, or Firm*—Kurt Kelman

[57] ABSTRACT

The paper tube making machine is improved to reduce the floor space required for the installation and operation of the machine and enhance the efficiency of paper tube production by arraying in parallel a plurality of fixed shafts adapted to coil one or two paper tapes thereon and vertically disposing arm plates serving to support at least one endless rolling belt diagonally wound around the fixed shafts.

4 Claims, 4 Drawing Figures

APPARATUS FOR MANUFACTURE OF PAPER TUBE

BACKGROUND OF THE INVENTION

This invention relates to improvements in and concerning a machine for the manufacture of paper tubes by diagonally rolling a paper tape. More particularly this invention relates to a paper tube making machine having the productivity thereof improved by vertically disposing belts serving to roll paper tape thereby saving floor space for the installation of the machine and, at the same time, causing a plurality of rolling belts and a plurality of fixed shafs as paper tape rolling shafts to be disposed parallel.

In addition to the paper tube making machines proposed by the inventor in Japanese Patent Publications No. 17568/1977, No. 529/1978, and No. 2208/1978, many paper tube making machines have been known to the art. All these conventional machines share a construction wherein pulleys are raised with vertical shafts at the opposite ends of a horizontal arm plate disposed diagonally below a fixed shaft and an endless rolling belt wound diagonally one complete turn around the fixed shaft is passed round the two pulleys and stretched taut. In this construction, however, the arm plate protrudes considerably from the left and right lateral sides of the machine frame. When the machine is to be installed adjacent to a wall in a work shop, for example, the end of the arm plate protruding from the machine frame prevents the machine from being brought any further toward the wall. Thus, the installation of this machine calls for a large wasteful space just for the accommodation of the protruding arm plate. Besides, when a large number of produced paper tubes are to be bundled up and carried away such as on a forklift, for example, the forklift operator is required to take care to avoid collision of the forklift against the protruding arm plate. Moreover, since the conventional machine uses just one fixed shaft per machine, desired enhancement of the efficiency of paper tube production has had no alternative but to rely on an increase in the operating speed of the rolling belt. The operating speed of the rolling belt, however, is limited by the quality of paper tape used for the production of paper tubes and the type of paste used for bonding the rolled paper tape. When the rolling belt is operated at a speed exceeding the limit, the pasted portion of the freshly produced paper tube comes apart after the paper tube has passed the rolling zone relative to the fixed shaft of the rolling belt. Thus, the product has to be rejected. The rolling belt, accordingly, is operated at the highest possible speed. Despite the precaution, rejectable products occur to a fair extent. There is a further problem that bearings and other frictional parts as well as the rolling belt undergo heavy wear and require frequent replacement.

Alternatively, two horizontal arm plates are disposed below the fixed shaft in the shape of the letter X as proposed by the inventor's Japanese Patent Publication No. 17568/1977, or such two horizontal arm plates are disposed either independently or connectedly in the shape of the letter V as suggested by the conventional methods and touched upon in the patent publication mentioned above by way of reference to the prior art. Between the pulleys disposed at the opposite ends of each of the arm plates, two rolling belts are stretched taut with the directions of their inclinations reversed to each other. When the two belts are diagonally wound around the static shaft in the opposite directions to each other, the direction of the static shaft can be corrected and straightened out in the horizontal direction by relatively adjusting the tensions of the two rolling belts. The core cutting shaft which is projected extendedly from the leading end of the fixed shaft is generally supported in position on the opposed peripheral surfaces of two parallel support rollers disposed adjacently to each other. If the fixed shaft is capable of being corrected in the horizontal direction by the relative adjustment of the two belts, it does not necessarily follow that the fixed shaft will be effectively pressed against the opposed peripheral surfaces of the two support rollers. Although the core cutting shaft is supported in position on the opposed peripheral surfaces of the two support rollers, it is susceptible to considerable bouncing while the machine is in operation, with the result that the pasted portion of the freshly produced paper tube slides out of position and loses adhesive strength. Thus, there is a possibility of the paper tube being produced not in a straight form as desired but in a warped form.

SUMMARY OF THE INVENTION

An object of this invention is to provide a paper tube making machine which can be installed on a much smaller floor space than normally required heretofore and which permits paper tubes of good quality to be produced in an increased amount at the same operating speed as the conventional machine.

To accomplish the object described above according to the present invention, there is provided a paper tube making machine, which comprises a machine frame, at least two fixed shafts disposed parallel to each other in a horizontal direction and supported at only one end by the machine frame, at least two sets of endless belts wound diagonally around the fixed shafts, and at least two sets of vertically disposed arm plates each provided at the opposite ends thereof with pulleys for supporting the endless belts.

When two endless belts are provided for each of the fixed shafts, the arm plates for supporting these endless belts are disposed in the shape of the letter X or the letter V. Since these arm plates are vertically disposed, the floor space required for the installation and operation of the machine is small as compared with the floor space normally required to date. Since two or more fixed shafts are parallel disposed in the horizontal direction, the amount of paper tube which can be produced is at least doubled. Since either of the pair of pulleys serving to support the endless belts is provided with means for adjusting the tensions of the endless belts, the endless belts can be made to assume the optimum rolling condition. Owing to these improvements, the machine of the present invention is capable of producing paper tubes of high quality.

The other objects and characteristics of the present invention will become apparent from the further disclosure of the invention to be made hereinbelow with reference to the accompanying drawings.

DESCRIPTION OF THE PREFERRED EMBODIMENTS

This invention relates to a paper tube making machine which, owing to the vertical disposition of arm plates for supporting the rolling belts, permits a reduction in the floor space required for the installation and operation of the machine and enables paper tubes of good quality to be produced with improved efficiency.

Figure 1:
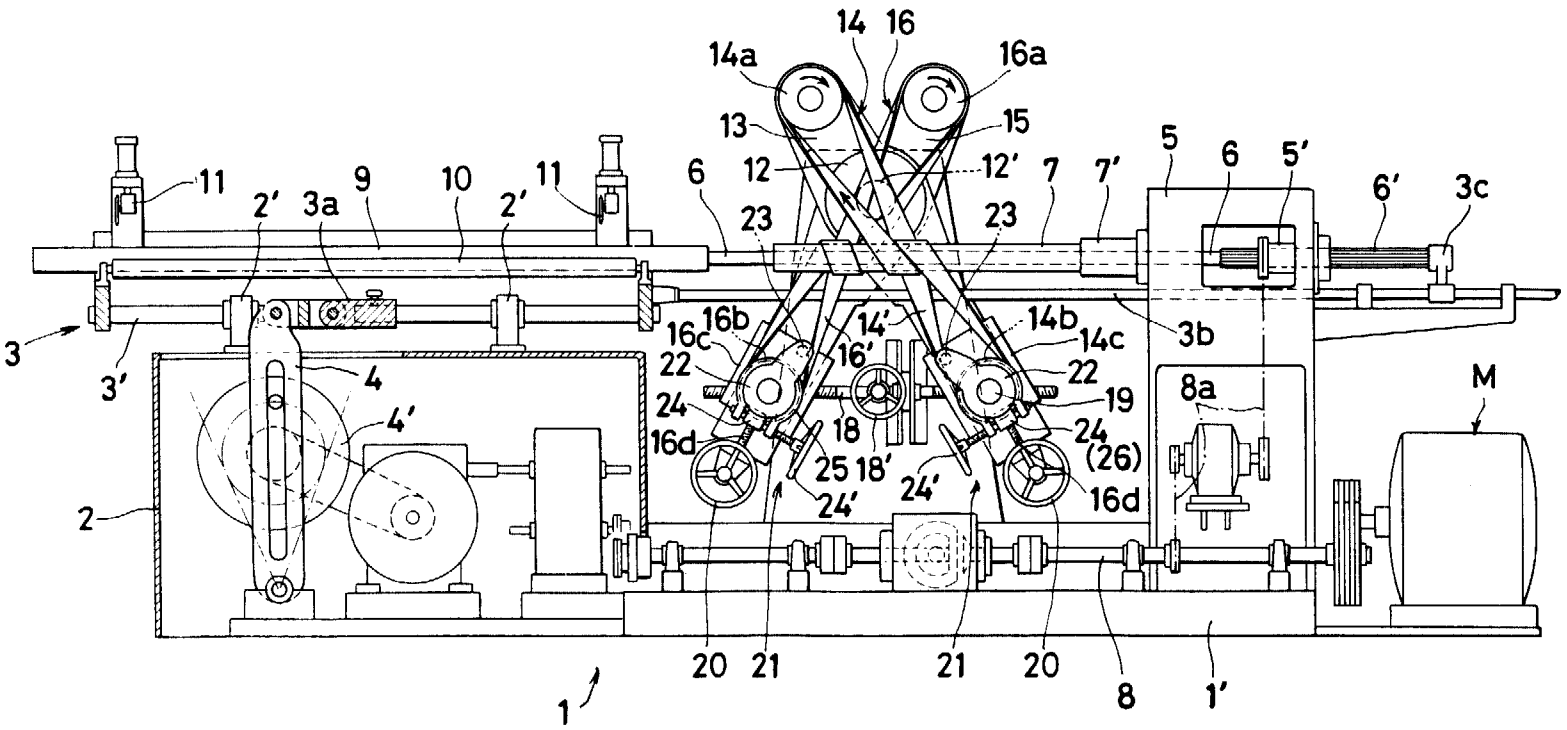
FIG. 1 is a front view of one embodiment of the paper tube making machine according to the present invention.
Figure 2:
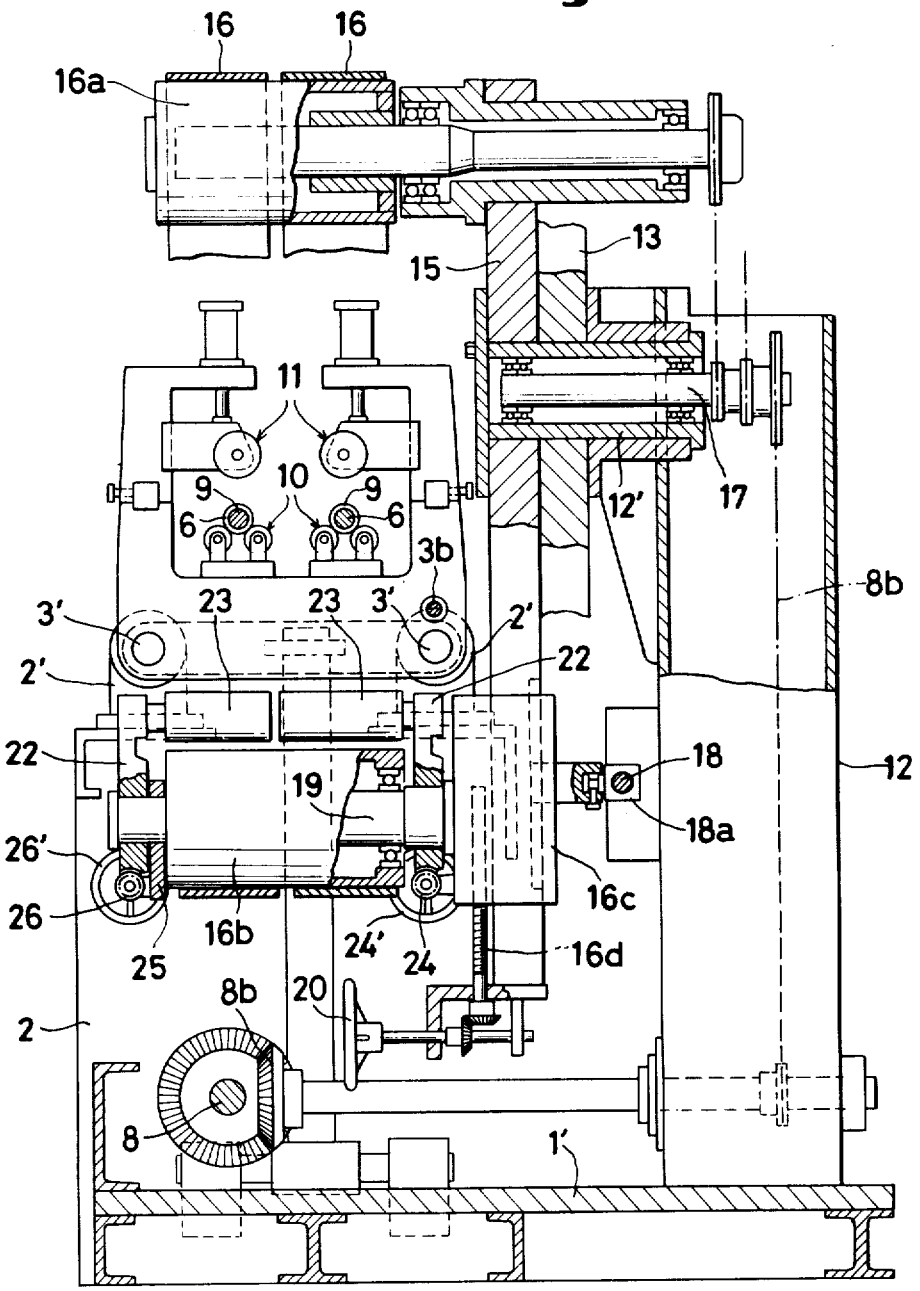
FIG. 2 is a sectioned side view of the embodiment of FIG. 1.

FIGS. 1 and 2 illustrate an embodiment of the paper tube making machine of the present invention. On the front end of a bed 1' of a machine frame 1, there is a cutter base 2. On the cutter base 2, a sliding table 3 is supported slidably in the longitudinal direction. It is slid back and forth by a reciprocating device such as, for example, a rocking arm 4. The sliding table 3 is provided on the left and right of the lower surface thereof with longitudinally disposed guide rods 3'. These guide rods are supported on the cutter base by being slidably pierced through guide means 2' which are paired off on the left and right of the upper surface of the cutter base and separated in the longitudinal direction. The rocking arm 4 is rocked in the longitudinal direction by having its lower end pivotally fixed on the bed. The upper end of the rocking arm 4 protrudes upwardly from the cutter base and is pivotally fastened to a connecting device 3*a* fixed between the guide rods 3'. On the rear end of the bed, a main shaft base 5 is disposed. Two spindles 6 in the case of the illustrated embodiment are disposed parallelly to each other across a fixed distance in one horizontal plane and slidably pierced in the longitudinal direction through the main shaft base. On the front end surface of the main shaft base, two chucks 7' adapted to catch and hold in position the rear ends of hollow fixed shafts 7 serving as the cores for spirally rolling paper tape into paper tubes are disposed as separated from each other by the same distance as that separating the spindles 6. The spindles 6 project forward from the main shaft base and pierce through the chucks 7' and the hollow fixed shafts 7. The spindles are connected at their rear ends into spline shafts 6'. The spline shafts 6' slidably pierce through the spline grooves formed on the inner walls of rotary cylinders 5' supported within the main shaft base and allowed only to rotate around themselves, and they protrude from the rear surface of the main shaft base 5. On the bed 1', a driving shaft 8 rotated by a motor M is supported in position on bearings spaced in the longitudinal direction. By the rotary force to be received from the driving shaft 8 through the chain conveyor means 8*a*, the aforementioned rotary cylinders 5' are rotated in the same direction at the same speed as the paper tapes spirally rolled on the fixed shafts. The leading end of the driving shaft 8 conveys rotation to the crank 4' which reciprocates the rocking arm 4.

The cutter table 3 is further provided with a rod 3*b* which is extended rearwardly. This rod 3*b* pierces through the main shaft base 5 at a position below the spindles 6. The rear end of this rod 3*b* is connected through the medium of a connecting device 3*c* to the rear ends of the two spindles 6, i.e., the rear ends of the spline shafts 6'. By the reciprocation of the sliding table 3, the two spindles 6 are caused to produce a simultaneous longitudinal stroke. At the same time, they are rotated in the same direction by the rotary cylinders 5'.

Even when the spindles 6 are in their most retracted positions, their leading ends are located slightly in front of the leading ends of the respective fixed shafts 7. To the rear ends of the spindles, the rear ends of the core cutting shafts 9 having the same outside diameter as the respective fixed shafts 7 are connected. Even when the spindles are brought to their most retracted positions, the rear ends of the core cutting shafts 9 are never allowed to collide with the leading ends of the fixed shafts 7. On the sliding table 3, a pair of slender tangentially disposed support rollers 10 having the axes thereof falling in the longitudinal direction are laid parallel to each other. The core cutting shafts 9 are laid tangentially in the spaces separating the paired support rollers and are caused to produce a longitudinal stroke simultaneously with the spindles 6. On the sliding table 3, cutters 11 adapted to act on the core cutting shafts 9 so as to cut paper tubes are further disposed. To obtain a paper tube having substantially the same length as the sliding table 3, the cutters are required to be installed one each at the front end and the rear end of the table. To obtain paper tubes of a short length, additional cutters are required to be installed at one or more intermediate positions of the table besides those installed at the front end and the rear end of the table. During the forward travel of the table 3, the cutters 11 are actuated to cut the paper tube on the core cutting shafts by the signal issued at the time that the speed of the advance of the table is equalized with the speed at which the paper tube gains in length in the axial direction. The rearward travel of the sliding table 3 is quickly effected by a quick return mechanism. Prior to the next cutting, a small portion of the paper tube is cut off the front end thereof so that paper tubes of a fixed length will be obtained by repetition of the procedure described above. On the middle portion of the bed between the cutter base 2 and the main shaft base 5, a support column 12 is raised behind the two fixed shafts. At the upper end of the support column situated slightly above the fixed shafts, two arm plates 13, 15 in the illustrated embodiment are pivotally mounted in the shape of the letter X on a shaft 12' laid to intersect the fixed shafts perpendicularly. At the upper and lower ends of the arm plate 13, pulleys 14*a*, 14*b* are rotatably supported on shafts running parallel to the shaft 12'. Between the two pulleys, two endless rolling belts 14 each diagonally wound one complete turn around the corresponding fixed shaft 7 are stretched taut parallel to each other. Similarly at the upper and lower ends of the other arm plate 15, pulleys 16*a*, 16*b* are rotatably supported on shafts running parallel to the shaft 12' and two endless rolling belts 16 each diagonally wound one complete turn around the fixed shaft 7, though in an opposite direction relative to the belts 14, are stretched taut parallel to each other between the two pulleys. The rolling belts 14, 16 are in such a relative position that when one paper tape is diagonally fed to the fixed shafts, it is rolled over itself with one edge portion thereof overlapping the other edge portion thereof and, when a plurality of paper tapes is are similarly fed, they are rolled with one half width of one paper tape overlapping one opposite half width of another paper tape. In this manner, the one paper tape or the plurality of paper tapes are spirally wound on the fixed shafts with the overlapping portions pasted to each other. The paper tubes thus grow gradually and, are advanced toward the free ends of the fixed shafts.

Figure 3:
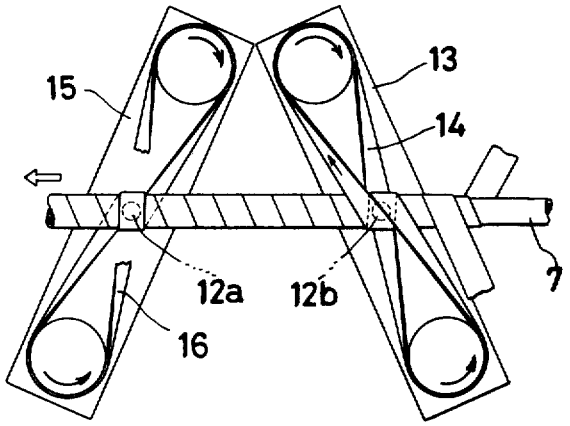
FIG. 3 is an explanatory diagram of an important part of another embodiment of the paper tube making machine of the present invention.
Figure 4:
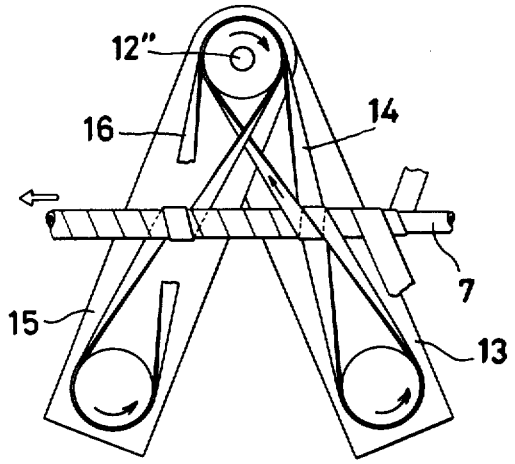
FIG. 4 is an explanatory diagram of an important part of yet another embodiment of the paper tube making machine of the present invention.

Of course, the two arm plates 13, 15 are not always required to be pivotally mounted in the shape of the letter X as in the illustrated embodiment. As illustrated in FIGS. 3 and 4, the two arm plates 13, 15 may be disposed in the shape of the letter V relative to the fixed shafts 7. For example, the arm plates 13, 15 can be independently disposed in the shape of the letter V and are fixed in position by shafts 12, **12*b* which are pivotally mounted on the support column as illustrated in FIG. 3. Alternatively, the arm plates 13, 15 can be disposed as illustrated in FIG. 4, so that the rolling belts 14, 16 may be stretched taut by use of one each of the paired pulleys provided on the arm plates 13, 15. In this case, the arm plates 13, 15 can be pivotally mounted on the support column 12 through the medium of the shaft 12''**. It is not essential to use two arm plates. There may be used just one arm plate as in the conventional two-pulley construction. In that case, the rolling belts may be wound one each around the fixed shafts.

To impart driving force to the rolling belts, an intermediate transmission shaft 17 is provided coaxially with the shaft 12' serving to attach the arm plates pivotally to the support column in much the same way as in the conventional construction. The intermediate transmission shaft 17 derives the rotation of the driving shaft 8 through the bevel gear and the chain transmission means **8*b* and delivers this rotation to the pulleys 14*a*, 16*a* disposed either on the upper or the lower ends of the arm plates, on the upper ends in the illustrated embodiment. Thus, the pulleys 14*a*, 16*b* are utilized as driving pulleys. The angles with which the rolling belts are diagonally wound on the fixed shafts must be readjusted whenever there is a change in the width of paper tapes to be used. To permit this readjustment, a turnbuckle 18 is supported in the longitudinal direction on the support column 12 so that it may be turned by a handle 18' through the medium of a bevel gear or worm mechanism, and a nut 18*a* adapted to be freely moved in the longitudinal direction of the arm plates and to be oscillated is provided behind the arm plates 13, 15. The front half of the turnbuckle 18 is helically set to the nut 18*a* of the arm plate 15 and the rear half thereof to the nut 18*a* of the arm plate 13. Consequently, the rotation of the handle 18' will cause the two arm plates 13, 15 to be turned about the shaft 12' as the fulcrum. The driven pulleys of the arm plates which are not directly driven, i.e. the pulleys 14*b*, 16*b* on the lower sides in the illustrated embodiment are rotatably attached to the stationary shafts 19 of the pulley bases 14*c*, 16*c* attached longitudinally slidably to the arm plates. To the pulley bases 14*c*, 16*c*, the male screw shafts 16*d* supported on the lower ends of the arm plates are helically joined. When the male screw shafts 16*d* are rotated by the handles 20, the pulley bases are slid in the longitudinal direction of the arm plates so that the two rolling belts 14, 16** laid parallel to each other may be simultaneously stretched or loosened amply to permit belt replacement.

When paper tapes are fed to the portions of the fixed shafts 7 on which the rolling belts 14 are wound, the rolled portions of the belts pull the paper tapes forward and, at the same time, roll them tightly on the peripheries of the fixed shafts and advance them forward. The paper tubes thus advanced are immediately retightened on the rolled portions of the belts 16 on the fixed shafts and spirally advanced toward the core cutting shafts. The sliding table longitudinally reciprocates in conjunction with the core cutting shafts. During the forward travel, the sliding table causes the cutters to cut the paper tubes on the core cutting shafts. Thus, two paper tubes of a fixed length can be produced at a time.

To ensure production of paper tubes of high quality, it is necessary that the tension of each belt should be adjustable independently of the other. In the machine of the present invention, the plurality of belts stretched between the pulleys have a substantially fixed length. Nevertheless, they differ slightly. When one belt has been in use of a long time and other belts are freshly replaced, the differences are widened because of elongation of belts due to prolonged use. In the conventional machine, since just one rolling belt is stretched between the paired pulleys, the tension of the rolling belts can be adjusted by means of the aforementioned means for sliding the pulley bases so that the belts may be wound with the optimum rolling force on the fixed shafts. In the machine of the present invention, however, the tension of the plurality of rolling belts involving differences in length and elongation cannot be wholly adjusted to offer the optimum rolling force by sliding the pulley bases.

Instead, this invention enables the tension of the individual belts to be adjusted by means of the respective adjusting devices 21 provided on the arms for the individual belts.

In the present embodiment, lever discs 22 each having a lever projecting from a disc are rotatably fitted to the basal ends and free ends of the stationary shafts 19 of the pulley bases **14*c*, 16*c*. To the leading ends of the levers, adjusting rollers 23 for the adjustment of tension are pivotally attached opposedly with their axes running parallel to the stationary shafts. Of the adjusting rollers 23, those of the two lever discs fitted to the stationary shaft of the pulley base 14*c* remain in contact with the inner surfaces of the idle zones 14' of the belts 14 passed around the driving pulleys 14*a*, sent behind the fixed shafts, and advanced toward the driven pulleys 14*b*. On the other hand, the adjusting rollers 23 of the two levers fitted to the stationary shaft of the pulley base 16*c* remain in contact with the inner surfaces of the idle zones 16' of the belts 16 passed around the driven pulleys 16*b*, sent behind the fixed shafts, and directed toward the driving pulleys 16*a*. The adjusting rollers, thus, push the respective idle zones 14', 16' of the belts outwardly. The pulley bases 14*c*, 16*c*, therefore, support in the tangential direction relative to the lever discs the shafts possessing worms 24 adapted to mesh with the worm wheel teeth formed on the periphery of the lever discs fitted to the basal ends of the stationary shafts, so that the worms 24 may be rotated by the handle 24'. To impart rotation to the lever discs fitted to the free ends of the stationary shafts, auxiliary discs 25 are fitted in conjunction with the lever discs to the free ends of the stationary shafts and are fixed thereto by use of keys or by virtue of welding. On these auxiliary discs 25, shafts possessing worms 26 are similarly supported in the tangential direction, with the worms 26 meshed with the worm wheel teeth formed on the peripheries of the lever discs. Thus, the worm shafts can be rotated by the handle 26'**.

Consequently, one of the two rolling belts stretched between the paired pulleys disposed at the ends of the arm plates rotates the handle 24' and the other rolling belt rotates the handle 26', with the result that the idle zones 14', 16' of the rolling belts are pushed outwardly and the belts are allowed to assume their respectively optimum tension. The rolling belts 14 are wound around the fixed shafts en route from the driven pulleys 14b to the driving pulleys 14a. Conversely, the rolling belts 16 are wound in the opposite direction around the fixed shafts en route from the driving pulleys 16a to the driven pulleys 16b. When the adjusting rollers 23 push the idle zones 14', 16' of the rolling belts outwardly, therefore, the angles with which the rolling belts are wound around the fixed shafts are not affected at all by the outward push given to the belts.

Moreover, by the adjustment of tension of the belts, the core cutting shafts at the leading ends of the fixed shafts 7 are displaced in the vertical direction. Where the two arm plates 13, 15 are pivotally attached to the support column 12 in the shape of the letter X as in the present embodiment or in the shape of the letter V in either of the two manners described above, the front one 16 of the belts stretched between the pulleys of the arm plates is given a slightly greater tension than the rear one 14 of the belts. Fortunately, the core cutting shafts 9 are pressed down tangentially on the paired support rollers 10 so that possible deflection is notably decreased. Thus, the possibility of the overlapped and pasted portion of the paper tape sliding out of position to the extent of impairing the strength of produced paper tubes or causing the produced paper tubes to be warped is completely eliminated. Where just one arm plate is used instead of two, therefore, it is desirable to use the arm plate 15 which causes the core cutting shafts to be pushed downwardly toward the paired support rollers owing to the adjustment of the tension of belts.

As is apparent from the description so far given, this invention causes the arm plates which have been horizontally disposed according to convention to be vertically disposed by being pivotally attached to the front surface of the support column 12 raised upright from the bed 1 and, thus, eliminates all the problems issuing from the horizontal disposition of the arm plates. It further permits a plurality of paper tubes to be produced at once by having a plurality of rolling belts stretched taut between the pulleys disposed at the ends of the arm plates and causing the rolling belts to be wound around the respective fixed shafts. In this case, since the tension of each rolling belt can be adjusted independently of the other rolling belt, the paper tubes produced on the fixed shafts have good quality.

Since the machine is capable of producing a plurality of paper tubes at the same time, it enjoys high productivity even if the operational speed of the machine is lowered slightly as compared with the conventional machine. Consequently, the wear on machine parts can be reduced remarkably and the service life of the machine itself can be lengthened. For effective operation of the machine, a slight addition to the power of the driving motor will suffice. Thus, the production cost per paper tube obtained by this machine is very low.

In the embodiment described so far two rolling belts are stretched between the paired driving and driven pulleys. Optionally, simultaneous production of more paper tubes can be accomplished by fixing the auxiliary discs 25 to the stationary shaft 19 thereby permitting at least three rolling belts to be stretched and increasing the number of fixed shafts to 3 or more. In the present embodiment, there is provided means for sliding the pulley bases. This means can be utilized for imparting tension, though to a limited extent, to the plurality of rolling belts stretched between the driving and driven pulleys. Thereafter, the tension of the individual belts can be adjusted by the adjusting devices 21 in accordance with the conditions in which paper tubes are produced on the fixed shafts. Optionally, the means for sliding the pulley bases may be omitted. In this case, the adjustment of belt tension and the slackening of belts for belt replacement may be effected solely by means of the adjusting devices 21.

In the present embodiment, a plurality of fixed shafts are disposed in front of the support column and as many rolling belts as the fixed shafts which are stretched taut between the pulleys disposed at the ends of the arm plates pivotally attached to the front surface of the support column are found one each on the fixed shafts. Optionally, a plurality of fixed shafts may be arrayed on the rear side of the support column and arm plates pivotally attached to the rear side of the support column coaxially with those on the front side and as many rolling belts as the fixed shafts stretched between the pulleys disposed at the ends of the arm plates and wound one each around the fixed shafts. Naturally, in this case, the sliding table 3 is required to be provided with support rollers serving to support horizontally in position the core cutting shafts at the leading end of the fixed shafts arrayed on the rear side of the support column. Because of the addition of fixed shafts on the rear side of the support column besides those disposed in front, the number of paper tubes to be manufactured by the machine can be increased. The machine, accordingly, enjoys added productivity.

What is claimed is:

1. A paper tube making machine, comprising in combination a machine frame; at least two hollow fixed shafts disposed parallel to each other and attached at the base ends thereof to said machine frame; at least one arm plate pivotally mounted on said machine frame at an angle relative to said fixed shaft; at least two sets of opposite pulleys, one of each set of pulleys being mounted on one end portion of said arm plate, the other of each set of pulleys being mounted on a pulley base attached slidably to said arm plate, at least two endless rolling belts each stretched between each set of opposite pulleys and wound diagonally around one of said fixed shafts so as to roll one or more paper tapes being supplied between itself and the corresponding fixed shaft; a pulley adjusting means adapted to slide said pulley base in the longitudinal direction of said arm plate so as to simultaneously stretch or loosen said at least two endless rolling belts; belt-tension adjusting devices provided on said arm plate for the individual endless rolling belts so as to adjust the tension of the individual endless rolling belts; spindles pierced through the interiors of the fixed shafts; core cutting shafts connected coaxially to the front ends of the spindles protruding from the free ends of the fixed shafts by means of a connector; a sliding table disposed on the machine frame so as to be slid axially on the core cutting shafts and adapted to support the core cutting shafts in a horizontal direction; means for integrally reciprocating said spindles, said connectors for said core cutting shafts and said sliding table; and means for rotating said connectors.

2. The paper tube making machine according to claim 1, wherein the fixed shafts are provided with two endless belts and two arm plates serving to support said endless belts.

3. The paper tube making machine according to claim 2, wherein the two arm plates are disposed in the shape of the letter X.

4. The paper tube making machine according to claim 2, wherein the two arm plates are disposed in the shape of the letter V.

* * * * *